US008496240B1

(12) United States Patent
Tu et al.

(10) Patent No.: US 8,496,240 B1
(45) Date of Patent: Jul. 30, 2013

(54) AUTOMATIC DOCUMENT FEEDER

(75) Inventors: Tung-Wen Tu, Taipei (TW); Long-Chao Zhao, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/463,546

(22) Filed: May 3, 2012

(30) Foreign Application Priority Data

Jan. 19, 2012 (CN) ..... 2012 1 0025104

(51) Int. Cl.
*B65H 3/06* (2006.01)

(52) U.S. Cl.
USPC ..... 271/117; 271/118; 271/3.14

(58) Field of Classification Search
USPC ..... 271/117, 118, 245, 3.14
See application file for complete search history.

(56) References Cited

U.S. PATENT DOCUMENTS 7,398,970 B2 * 7/2008 Morimoto et al. ..... 271/117
7,571,905 B2 * 8/2009 Kim ..... 271/117
7,686,291 B2 * 3/2010 Miyazawa ..... 271/117
7,717,415 B2 * 5/2010 Kim et al. ..... 271/110
2002/0033572 A1 * 3/2002 Takisawa et al. ..... 271/109

* cited by examiner

*Primary Examiner* — Prasad Gokhale
(74) *Attorney, Agent, or Firm* — Kirton McConkie; Evan R. Witt

(57) ABSTRACT

An automatic document feeder includes an upper cover, a document pick-up module, and a conveying channel. The upper cover has a first hooking element. The document pick-up module is arranged between the upper cover and the conveying channel. In addition, the document pick-up module has a second hooking element. When the automatic document feeder is operated in a standby mode, the document pick-up module is swung to a position near the upper cover and the second hooking element is engaged with the first hooking element, so that the document pick-up module is fixed on the upper cover. Since the document pick-up module is not contacted with the document when the automatic document feeder is operated in the standby mode, the possibility of causing an erroneous action of the document pick-up module will be eliminated.

9 Claims, 7 Drawing Sheets

AUTOMATIC DOCUMENT FEEDER

FIELD OF THE INVENTION

The present invention relates to an automatic document feeder, and more particularly to an automatic document feeder with a document stopper.

BACKGROUND OF THE INVENTION

With increasing development of scientific technologies, the method for storing documents is changed from the filing of paper documents to the storage of the documents' electronic files. Generally, a scanning apparatus is a device for scanning the contents of paper documents into electronic files, so that the electronic files may be further spread, managed or stored.

In the early stage, the scanning apparatus can only scan one side of the document. For scanning both sides of the document, after one side of the document has been scanned, the document should be manually turned over so as to scan the other side of the document. However, the process of manually turning over the document is troublesome. For solving the drawbacks, an automatic document feeder is usually integrated with a flatbed scanning portion. Consequently, a stack of documents can be successively transported by the automatic document feeder and a duplex scanning operation can be performed by the flatbed scanning portion the without the need of manually turning over the documents.

Conventionally, the automatic document feeder and the flatbed scanning portion are integrated into an image scanning apparatus. Hereinafter, a conventional image scanning apparatus will be illustrated with reference to FIG. 1. FIG. 1 is a schematic side view illustrating the automatic document feeder and the flatbed scanning portion of a conventional image scanning apparatus. This conventional image scanning apparatus is disclosed in for example U.S. Pat. No. 6,792,241. As shown in FIG. 1, the conventional image scanning apparatus 1 comprises a document pick-up module 10, an upper cover 11, a separation pad 12, a document stopper 13, a conveying channel 14, a document input tray 15, a document discharge tray 16, plural conveying roller assemblies 17, and a document discharge roller assembly 18. The document input tray 15 is used for placing plural documents S thereon. The document discharge tray 16 is disposed under the document input tray 15. After the plural documents S are scanned, the scanned documents S are placed on the document discharge tray 16. The document pick-up module 10 is disposed under the upper cover 11 for transporting the plural documents S from the document input tray 15 into the conveying channel 14. The document pick-up module 10 comprises a pick-up roller 101 and a separation roller 102. The pick-up roller 101 is used for contacting the plural documents S, thereby transporting the plural documents S. The separation roller 102 is used for separating the uppermost document S from the underlying documents, so that only a single document S is fed into the conveying channel 14. The separation pad 12 is disposed under the separation roller 102 for providing a friction force to the document S that is in contact with the separation pad 12, thereby facilitating the separation roller 102 to transport a single document S into the conveying channel 14.

The document stopper 13 is disposed under the document pick-up module 10. The document stopper 13 may be selectively in a protruded status or a stored status. In a case that the document stopper 13 is in the protruded status, the plural documents S are stopped from being fed into the conveying channel 14. Whereas, in a case that the document stopper 13 is in the stored stats, the plural documents S can be fed into the conveying channel 14 without being stopped by the document stopper 13. The plural conveying roller assemblies 17 are disposed in the conveying channel 14 for moving the plural documents S along the conveying channel 14. The document discharge roller assembly 18 is located beside the document discharge tray 16 for ejecting the plural documents S to the document discharge tray 16. The flatbed scanning portion 2 is disposed under the automatic document feeder 1. The flatbed scanning portion 2 has a scanning module 20. The conveying channel 14 goes through a region over the scanning module 20. When the document S is transported across the region over the scanning module 20, the document S is scanned by the scanning module 20.

Hereinafter, the operations of the automatic document feeder 1 will be illustrated with reference to FIGS. 1, 2 and 3. FIG. 2 is a schematic partial side view illustrating the conventional automatic document feeder in a standby mode. In a case that the conventional automatic document feeder is operated in the standby mode, the document pick-up module 10 is swung upwardly toward the upper cover 11 by using the separation roller 102 as the fulcrum. Meanwhile, the document stopper 13 is in the protruded status to block the conveying channel 14, so that the plural documents S are stopped from being fed into the conveying channel 14.

Please refer to FIGS. 1 and 3. FIG. 3 is a schematic partial side view illustrating the conventional automatic document feeder in a document-feeding mode. In a case that the conventional automatic document feeder is operated in the document-feeding mode, the document pick-up module 10 is swung downwardly to be distant from the upper cover 11 by using the separation roller 102 as a fulcrum. Meanwhile, the document stopper 13 is in the stored status, and the conveying channel 14 is not blocked. Consequently, the pick-up roller 101 of the document pick-up module 10 is contacted with the plural documents S on the document input tray 15, thereby transporting the plural documents S. During the process of transporting the plural documents S by the pick-up roller 101, the uppermost document S of the plural documents S are contacted with the separation roller 102, and the lowermost document S of the plural documents S are contacted with the separation pad 12. In response to the friction provided by the separation pad 12, the uppermost document S is separated from the underlying documents and fed into the conveying channel 14.

Next, the document S is transported by the plural conveying roller assemblies 17, so that the document S is moved along the conveying channel 14. When the document S is moved across the region over the scanning module 20, the document S is scanned by the scanning module 20, so that a scanned image of the document S is acquired. Afterwards, the scanned document S is transported by the document discharge roller assembly 18 to be ejected to the document discharge tray 16. Under this circumstance, the scanning operation of the uppermost document S has been completed. The processes of scanning the remaining documents S are similar to the above process, and are not redundantly described herein.

However, the conventional automatic document feeder still has some drawbacks. In a case that the automatic document feeder 1 is operated in the standby mode and the action of picking up the document is not done, the document pick-up module 10 is swung upwardly toward the position near the upper cover 11. For allowing the document pick-up module 10 to be stayed at the position near the upper cover 11, the document pick-up module 10 should acquire sufficient electricity from the automatic document feeder 1. Generally, for saving electricity, the commercially available automatic document feeder may be operated in a power-saving mode or a sleep mode. In a case that the conventional automatic document feeder 1 is operated in the power-saving mode or the sleep mode, the electricity is usually insufficient to allow the document pick-up module 10 to be stayed at the position near the upper cover 11. That is, since the document pick-up module 10 fails to be stayed at the position near the upper cover 11 in the power-saving mode or the sleep mode, the gravity of the document pick-up module 10 may allow the document pick-up module 10 to be naturally and downwardly swung and sustained against the document stopper 13. Under this circumstance, the document stopper 13 is readily changed from the protruded status to the stored status, so that the functions of blocking the conveying channel 14 and stopping the documents is lost.

If the user does not realize that the conventional automatic document feeder 1 is operated in the power-saving mode or the sleep mode at this moment, after the plural documents are placed on the document input tray 15, the plural documents are readily introduced into the conveying channel 14. The reason is because the conveying channel 14 is not effectively blocked by the document stopper 13. After the conventional automatic document feeder 1 is enabled and the electricity provided to the document pick-up module 10 is normal, the document stopper 13 is possibly stopped by the document within the conveying channel 14. Under this circumstance, the document stopper 13 fails to be protruded out, and thus the function of stopping the documents is lost. Consequently, when the document pick-up module 10 is operated in the document-feeding mode, a multi-feeding problem of simultaneously feeding two or more documents or a problem unable to feed any document (i.e. a non-feeding problem) may occur. Therefore, there is a need of providing an improved automatic document feeder for avoiding an erroneous action of the document pick-up module.

SUMMARY OF THE INVENTION

The present invention relates to an automatic document feeder for avoiding an erroneous action of the document pick-up module.

In accordance with an aspect of the present invention, there is provided an automatic document feeder for feeding at least one document. The automatic document feeder includes an upper cover, a conveying channel, and a document pick-up module. The upper cover has a first hooking element. The first hooking element is disposed on an inner surface of the upper cover. The conveying channel is used for allowing the at least one document to go through. The conveying channel is disposed under the upper cover. In addition, the conveying channel has a channel entrance. The document pick-up module is arranged between the upper cover and the channel entrance. When the automatic document feeder is operated in a document-feeding mode, the at least one document is transported into the conveying channel by the document pick-up module. The document pick-up module includes a casing and a second hooking element. The casing has a protrusion portion, which is disposed on an outer wall of the casing. The second hooking element is disposed on the casing and exposed to the outer wall. The second hooking element is rotatable relative to the casing. In addition, the second hooking element is engaged with the first hooking element when the automatic document feeder is operated in a standby mode. When the automatic document feeder is operated in the standby mode, the casing is swung to a position near the upper cover and the second hooking element is engaged with the first hooking element, so that the casing is fixed on the upper cover. Whereas, when the automatic document feeder is operated in the document-feeding mode, the second hooking element is disengaged from the first hooking element and the casing is swung to a position near the channel entrance, so that the document pick-up module is contacted with the at least one document for transporting the at least one document into the conveying channel.

In an embodiment, the document pick-up module further includes a pick-up roller, a separation roller, and a pick-up gear set. The pick-up roller is disposed within the casing and rotatable relative to the casing for transporting the at least one document into the conveying channel. The separation roller is disposed within the casing and rotatable relative to the casing for separating the at least one document, so that a single document transported by the pick-up roller is allowed to be fed into the conveying channel at each time. The pick-up gear set is connected with the pick-up roller and the separation roller, and located near an inner wall of the casing. Through the pick-up gear set, the pick-up roller and the second hooking element are rotated with the separation roller.

In an embodiment, the pick-up gear set includes a first pick-up gear, a second pick-up gear, and a third pick-up gear. The first pick-up gear is arranged between the separation roller and the casing, and connected with the separation roller, so that the first pick-up gear and the separation roller are synchronously rotated. The second pick-up gear is engaged with the first pick-up gear and connected with the second hooking element, so that the second pick-up gear is rotated with the first pick-up gear, and the second hooking element and the second pick-up gear are synchronously rotated. The third pick-up gear is arranged between the pick-up roller and the casing, connected with the pick-up roller, and engaged with the second pick-up gear, so that the third pick-up gear is rotated with the second pick-up gear and the pick-up roller is rotated with the third pick-up gear. When the automatic document feeder is operated in the standby mode, the first pick-up gear and the third pick-up gear are rotated in a second rotating direction, and the second hooking element and the second pick-up gear are rotated in a first rotating direction. When the automatic document feeder is operated in the document-feeding mode, the first pick-up gear and the third pick-up gear are rotated in the first rotating direction, and the second hooking element and the second pick-up gear are rotated in the second rotating direction.

In an embodiment, the casing further includes a hollow portion, wherein the hollow portion runs through the outer wall of the casing and an inner wall of the casing for accommodating the second hooking element. Preferably, the protrusion portion is integrally formed with the casing.

In an embodiment, the automatic document feeder further includes a document stopper. The document stopper is disposed on the upper cover, located near the outer wall of the casing, and rotatable relative to the upper cover. When the automatic document feeder is operated in the standby mode, the document stopper is pushed by the protrusion portion, so that the document stopper is swung to block the channel entrance.

In an embodiment, the channel entrance has an indentation structure, which is located beside the conveying channel. When the automatic document feeder is operated in the standby mode, the document stopper is contacted with the indentation structure to block the channel entrance. Whereas, when the automatic document feeder is operated in the document-feeding mode, the document stopper is not contacted with the indentation structure and the document stopper is pushed by the at least one document to be swung toward the upper cover, so that the at least one document is allowed to go through the channel entrance.

In an embodiment, the upper cover further includes plural guide plates. The plural guide plates are disposed on the inner surface of the upper cover and perpendicular to the inner surface for guiding the at least one document to be moved within the conveying channel. The document stopper is disposed on the plural guide plates. Moreover, the document stopper is permitted to be swung relative to the plural guide plates.

In an embodiment, the automatic document feeder further includes a driving device and a transmission mechanism. The driving device is disposed under the upper cover for providing a motive power. The transmission mechanism is connected with the driving device and the document pick-up module for transferring the motive power to the document pick-up module, so that the automatic document feeder is selectively operated in the document-feeding mode or the standby mode. The transmission mechanism includes a transmission belt, a transmission gear set, and a transmission shaft. The transmission belt is connected with the driving device for transferring the motive power. The transmission gear set is connected with the transmission belt, and rotatable in response to the motive power. The transmission shaft is penetrated through the transmission gear set and the document pick-up module. In response to the motive power, the transmission shaft is rotated in a first rotating direction or a second rotating direction, and the casing is swung to the position near the upper cover or the casing is swung to the position near the channel entrance.

In an embodiment, the transmission shaft is penetrated through a separation roller of the document pick-up module and the casing, so that the separation roller is rotated in response to the motive power. Preferably, the driving device is a driving motor. When the transmission shaft is rotated in the first rotating direction, the automatic document feeder is operated in the document-feeding mode. When the transmission shaft is rotated in the second rotating direction, the automatic document feeder is operated in the standby mode.

In an embodiment, the second hooking element is connected with the separation roller through a pick-up gear set of the document pick-up module, so that the second hooking element is rotated with the transmission shaft. When the transmission shaft is rotated in the second rotating direction, the automatic document feeder is operated in the standby mode, and the second hooking element is rotated in the first rotating direction. As the second hooking element is rotated in the first rotating direction, the casing is swung to the position near the upper cover and the second hooking element is engaged with the first hooking element, so that the document pick-up module is fixed on the upper cover without being contacted with the at least one document. When the transmission shaft is rotated in the first rotating direction, the automatic document feeder is operated in the document-feeding mode and the second hooking element is rotated in the second rotating direction. As the second hooking element is rotated in the second rotating direction, the second hooking element is disengaged from the first hooking element and the casing is swung to the position near the channel entrance, so that the document pick-up module is contacted with the at least one document for transporting the at least one document into the conveying channel.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
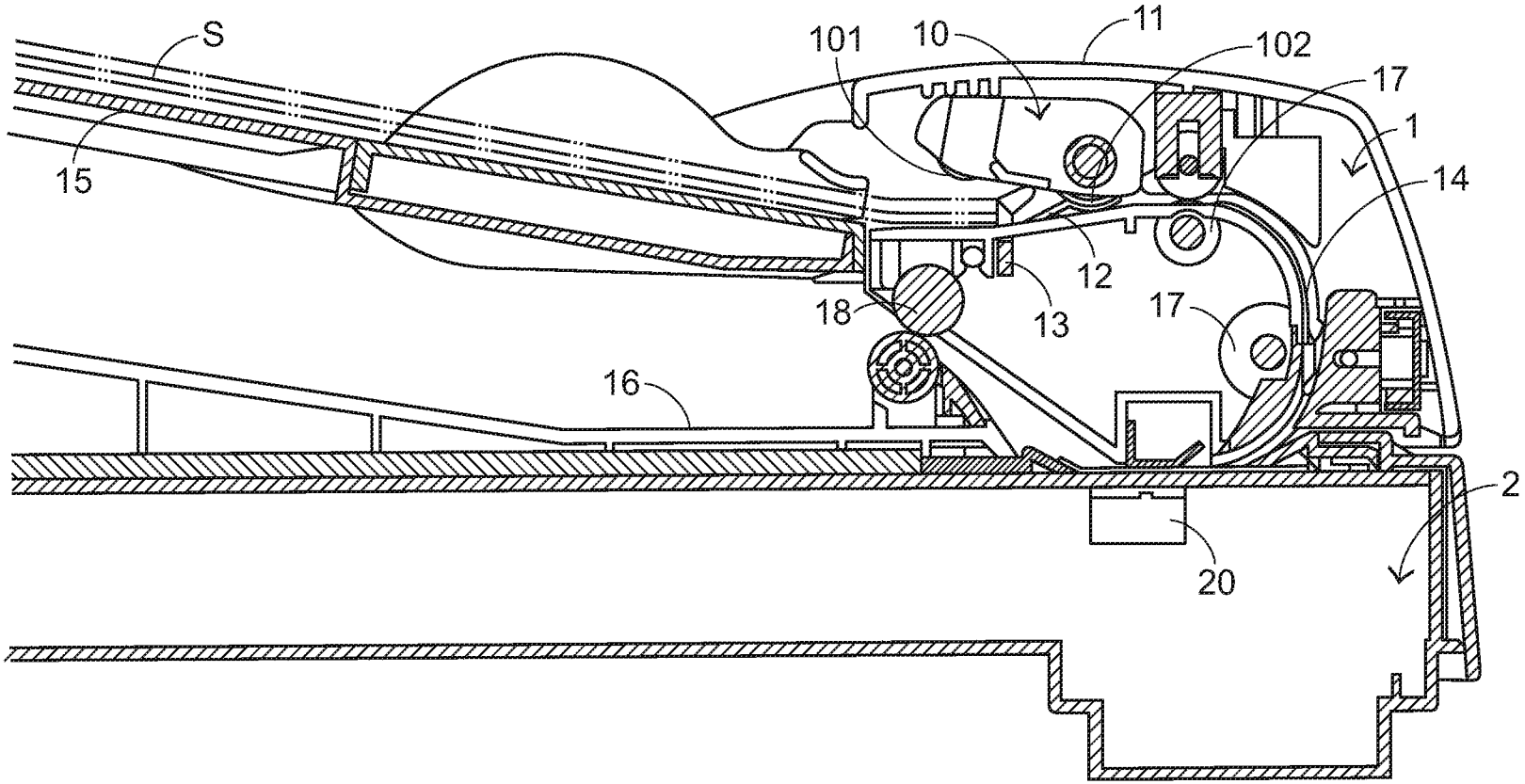
FIG.1 PRIOR ART
FIG. 1 is a schematic side view illustrating the automatic document feeder and the flatbed scanning portion of a conventional image scanning apparatus.
Figure 2:
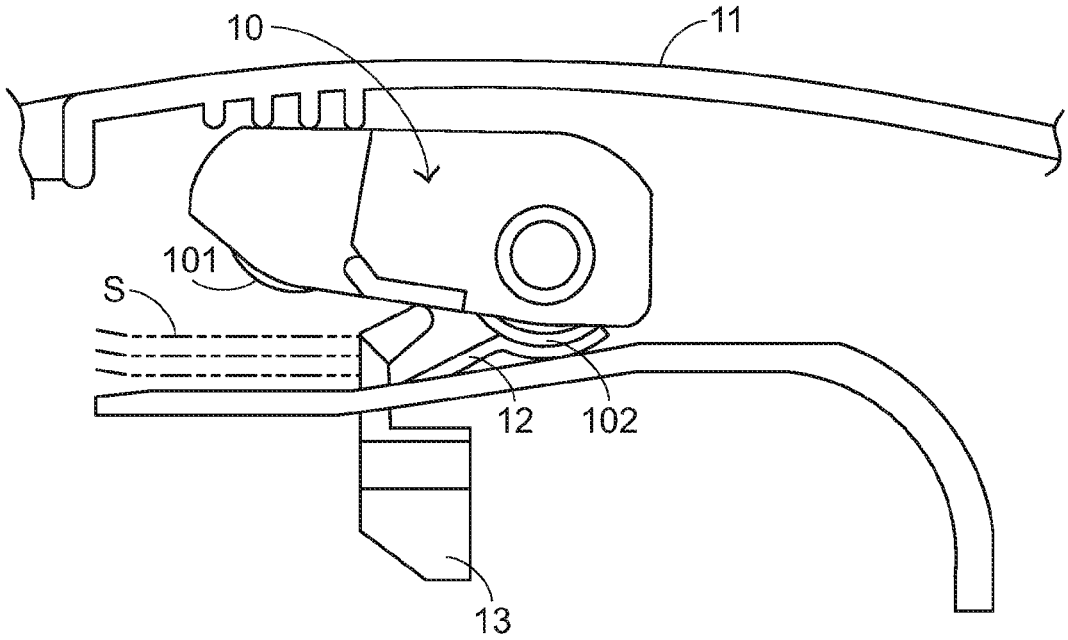
FIG.2 PRIOR ART
FIG. 2 is a schematic partial side view illustrating the conventional automatic document feeder in a standby mode.
Figure 3:
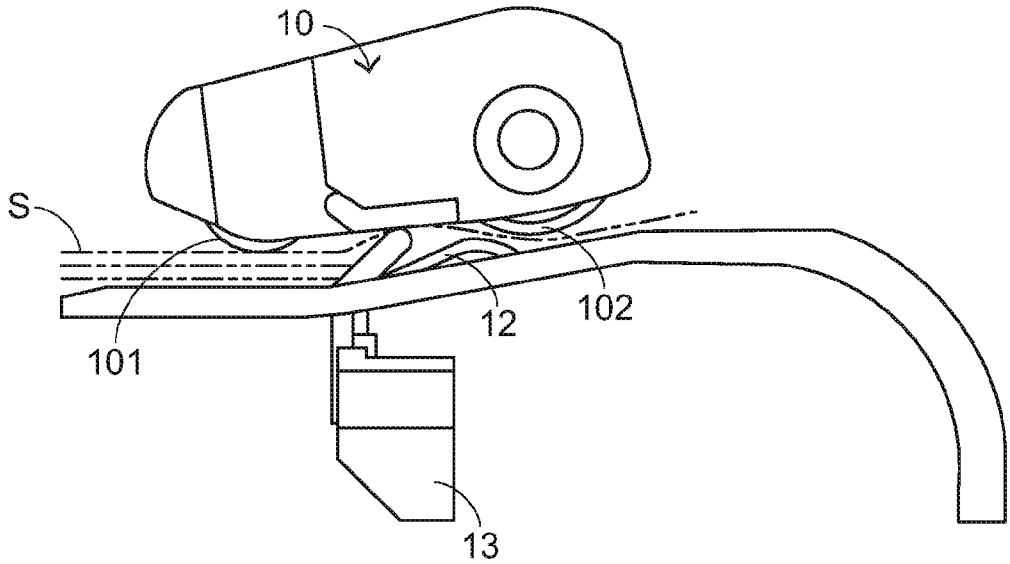
FIG.3 PRIOR ART
FIG. 3 is a schematic partial side view illustrating the conventional automatic document feeder in a document-feeding mode.
Figure 4:
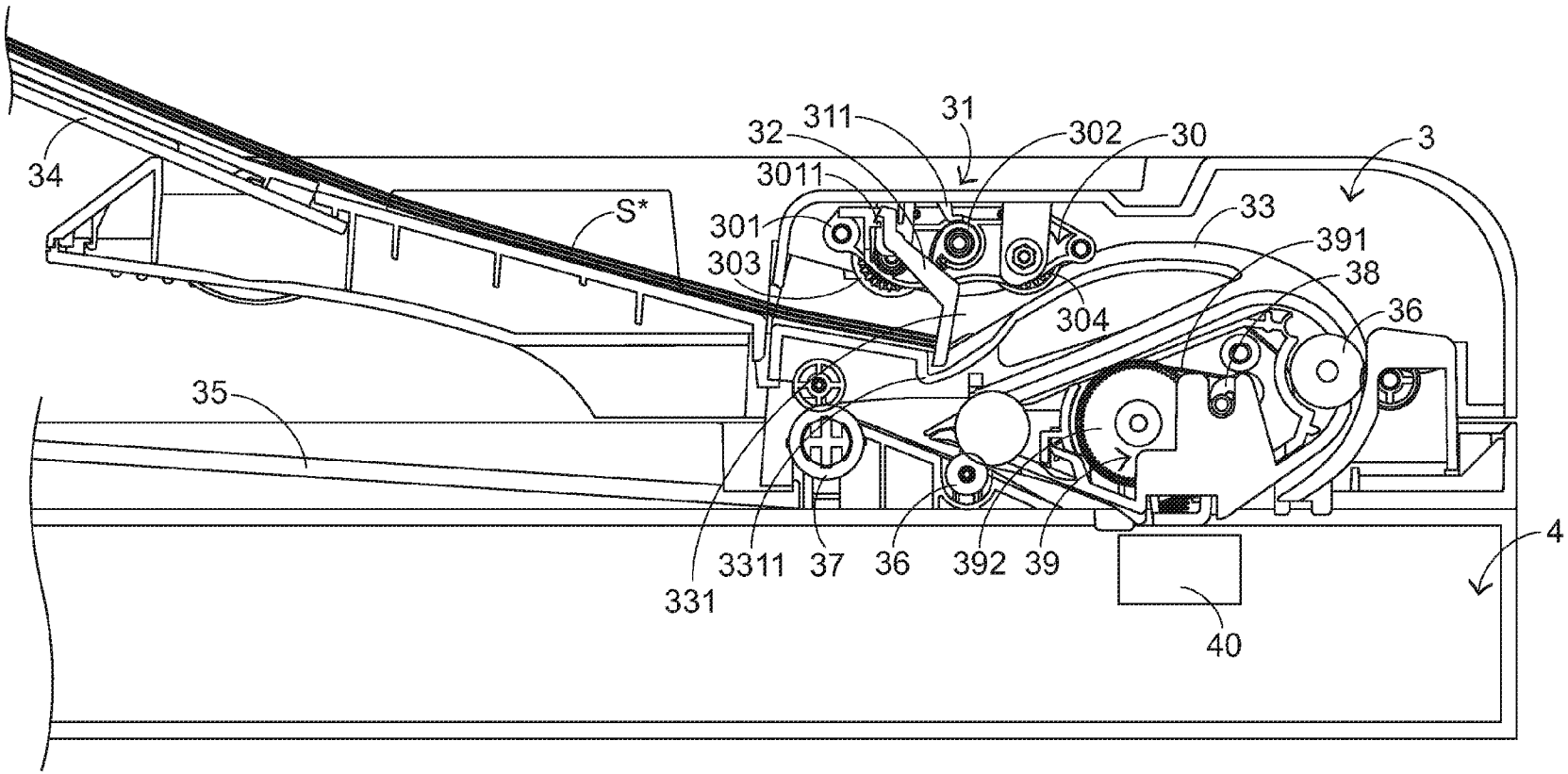
FIG. 4 is a schematic side view illustrating an automatic document feeder and a flatbed scanning portion of an image scanning apparatus according to an embodiment of the present invention.

For solving the drawbacks encountered from the prior art, the present invention provides an automatic document feeder. FIG. 4 is a schematic side view illustrating an automatic document feeder and a flatbed scanning portion of an image scanning apparatus according to an embodiment of the present invention. As shown in FIG. 4, the image scanning apparatus 3 comprises a document pick-up module 30, an upper cover 31, a document stopper 32, a conveying channel 33, a document input tray 34, a document discharge tray 35, plural conveying roller assemblies 36, a document discharge roller assembly 37, a driving device 38, and a transmission mechanism 39. The conveying channel 33 is disposed under the upper cover 31. In addition, the conveying channel 33 has a channel entrance 331. The conveying channel 33 is used for allowing at least one document S* to go through. The document input tray 34 is used for placing the at least one document S* thereon. The document discharge tray 35 is disposed under the document input tray 34. After the at least one document S* is scanned, the scanned document S* is placed on the at least one document S*. The document pick-up module 30 is disposed under the upper cover 31 for transporting the at least one document S* from the document input tray 34 into the conveying channel 33. The conveying roller assemblies 36 are disposed in the conveying channel 33 for moving the at least one document S* along the conveying channel 33. The document discharge roller assembly 37 is located beside the document discharge tray 35 for ejecting the at least one document S* to the document discharge tray 35. The flatbed scanning portion 4 is disposed under the automatic document feeder 3. The flatbed scanning portion 4 has a scanning module 40. The conveying channel 34 goes through a region over the scanning module 40. When the at least one document S* is transported across the region over the scanning module 40, the at least one document S* is scanned by the scanning module 40.

Figure 5:
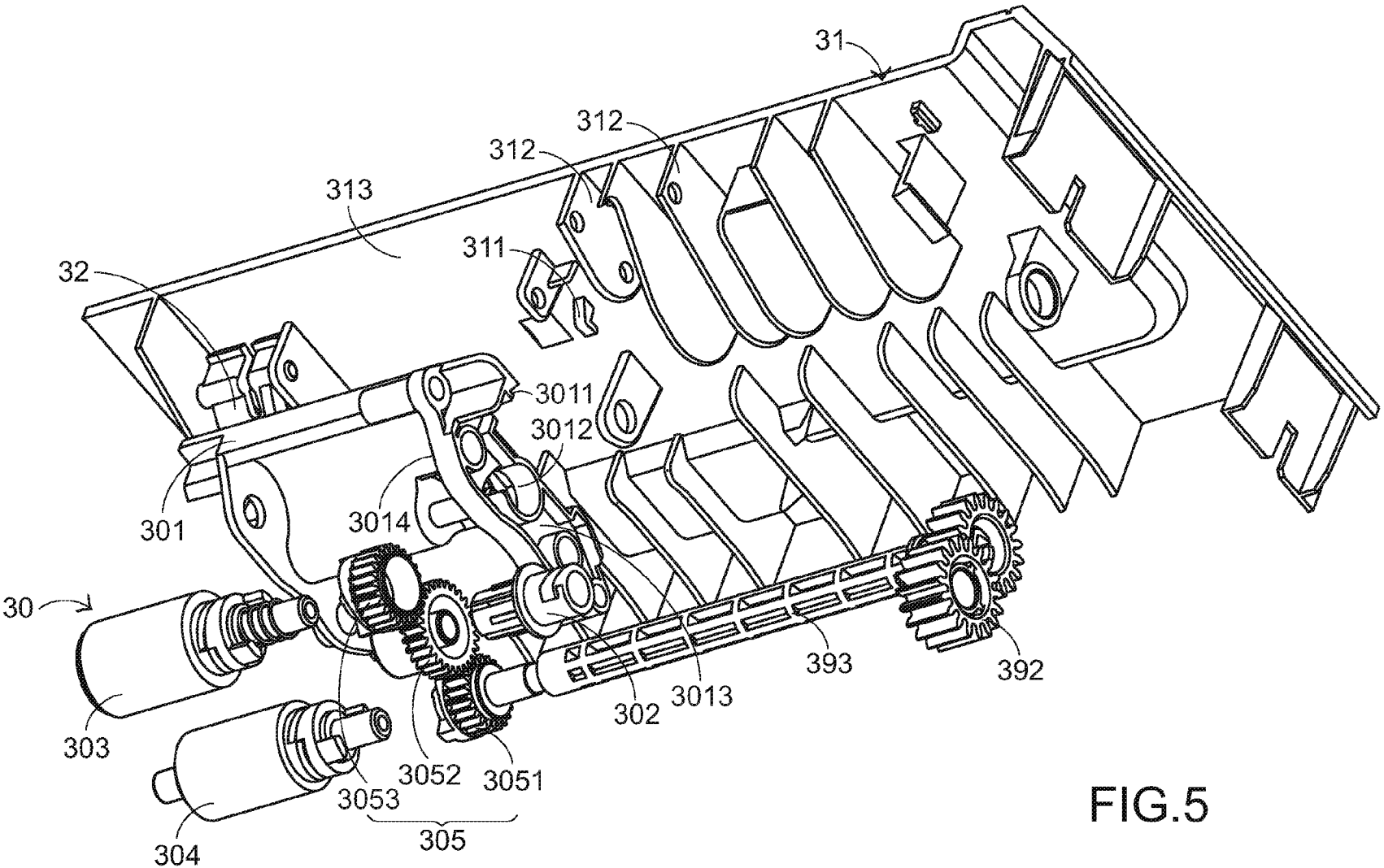
FIG. 5 is a schematic exploded view illustrating some components of the automatic document feeder according to an embodiment of the present invention.

FIG. 5 is a schematic exploded view illustrating some components of the automatic document feeder according to an embodiment of the present invention. Please refer to FIGS. 4 and 5. The driving device 38 is disposed under the upper cover 31 for providing a motive power. In this embodiment, the driving device 38 is a driving motor. The transmission mechanism 39 is connected with the driving device 38 and the document pick-up module 30 for transferring the motive power to the document pick-up module 30. Consequently, the automatic document feeder 3 is selectively operated in a document-feeding mode or a standby mode. Moreover, the transmission mechanism 39 comprises a transmission belt 391, a transmission gear set 392, and a transmission shaft 393. The transmission belt 391 is connected with the driving device 38 for transferring the motive power. The transmission gear set 392 is connected with the transmission belt 391. In response to the motive power provided by the driving device 38, the transmission gear set 392 is rotatable. The transmission shaft 393 is penetrated through the transmission gear set 392 and the document pick-up module 30. In response to the motive power, the transmission shaft 393 is rotated in a first rotating direction C1 (see FIG. 8) or a second rotating direction C2 (see FIG. 7).

For clearly showing the components of the automatic document feeder, the transmission gear set 392 of the transmission mechanism 39 is partially shown in FIGS. 4 and 5. The part of the transmission gear set 392 as shown in FIG. 4 is connected with the part of the transmission gear set 392 as shown in FIG. 5, so that the motive power may be transferred to the transmission shaft 393 to result in rotation of the transmission shaft 393.

Please refer to FIGS. 4 and 5 again. The upper cover 31 comprises a first hooking element 311 and plural guide plates 312. The first hooking element 311 is disposed on an inner surface 313 of the upper cover 31. The plural guide plates 312 are disposed on the inner surface 313 of the upper cover 31, and perpendicular to the inner surface 313. The plural guide plates 312 are used for guiding the at least one document S* to be moved within the conveying channel 33. In a preferred embodiment, the first hooking element 311 and the plural guide plates 312 are integrally formed with the upper cover 31. The document pick-up module 30 is arranged between the upper cover 31 and the channel entrance 331. In a case that the automatic document feeder 3 is operated in the document-feeding mode, the at least one document S* may be transported into the conveying channel 33 by the automatic document feeder 3.

The document pick-up module 30 comprises a casing 301, a second hooking element 302, a pick-up roller 303, a separation roller 304, and a pick-up gear set 305. The casing 301 has a protrusion portion 3011 and a hollow portion 3012. The protrusion portion 3011 is disposed on an outer wall 3013 of the casing 301. The hollow portion 3012 runs through the outer wall 3013 and an inner wall of the casing 301. In addition, the hollow portion 3012 is used for accommodating the second hooking element 302. In a preferred embodiment, the protrusion portion 3011 is integrally formed with the casing 301. The second hooking element 302 is disposed within the hollow portion 3012. In addition, the second hooking element 302 is partially exposed to the outer wall 3013 of the casing 301. Consequently, the second hooking element 302 is rotatable within the hollow portion 3012 relative to the casing 301. In a case that the automatic document feeder 3 is operated in the standby mode, the second hooking element 302 is engaged with the first hooking element 311 of the upper cover 31. The pick-up roller 303 is disposed within the casing 301, and rotatable relative to the casing 301. The pick-up roller 303 is used for contacting the at least one document S*, thereby transporting the at least one document S*. The separation roller 304 is disposed within the casing 301, and rotatable relative to the casing 301. The separation roller 304 is used for separating the uppermost document S* from the underlying documents, so that only a single document S* is fed into the conveying channel 33.

Figure 6:
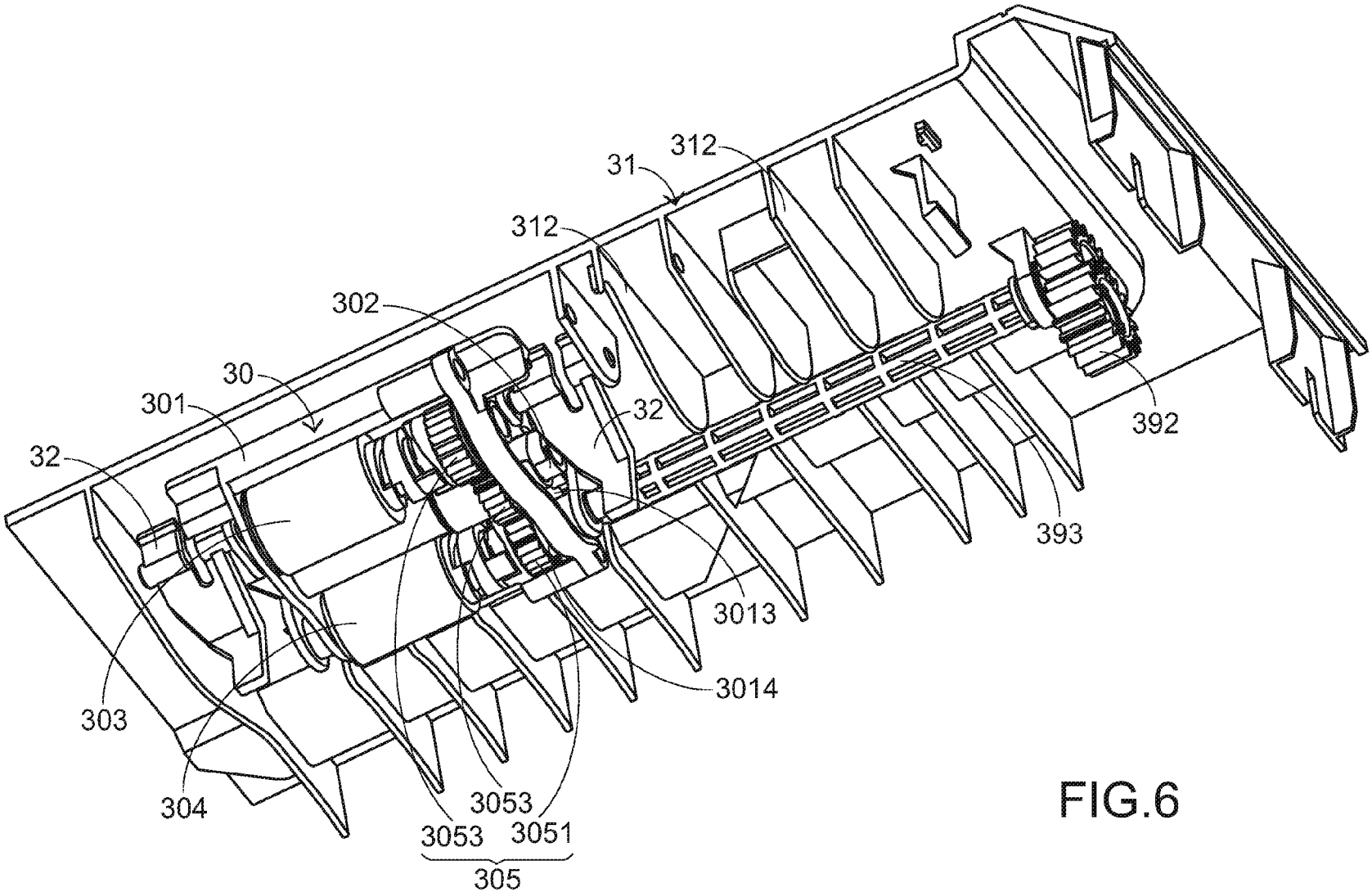
FIG. 6 is a schematic assembled view illustrating some components of the automatic document feeder of FIG. 5.

FIG. 6 is a schematic assembled view illustrating some components of the automatic document feeder of FIG. 5. Please refer to FIGS. 5 and 6. The pick-up gear set 305 is connected with the pick-up roller 303 and the separation roller 304. In addition, the pick-up gear set 305 is located beside the inner wall 3014 of the casing 301. Through the pick-up gear set 305, the pick-up roller 303 and the second hooking element 302 are rotated with the separation roller 304. The pick-up gear set 305 comprises a first pick-up gear 3051, a second pick-up gear 3052, and a third pick-up gear 3053. The first pick-up gear 3051 is arranged between the separation roller 304 and the casing 301. The transmission shaft 393 of the transmission mechanism 39 is penetrated through the casing 301 and the first pick-up gear 3051. Consequently, the first pick-up gear 3051 may be rotated in response to the motive power from the driving device 38 (see FIG. 6). Moreover, the separation roller 304 is partially inserted into the first pick-up gear 3051. Consequently, the separation roller 304 is connected with the first pick-up gear 3051, and the first pick-up gear 3051 and the separation roller 304 are synchronously rotated.

The second pick-up gear 3052 is engaged with the first pick-up gear 3051. Moreover, the second hooking element 302 is partially inserted into the second pick-up gear 3052. Consequently, the second hooking element 302 is connected with the second pick-up gear 3052, the second pick-up gear 3052 is rotated with the first pick-up gear 3051, and the second hooking element 302 and the second pick-up gear 3052 are synchronously rotated. The third pick-up gear 3053 is arranged between the pick-up roller 303 and the casing 301. The third pick-up gear 3053 is engaged with the second pick-up gear 3052, so that the third pick-up gear 3053 is rotated with the second pick-up gear 3052. Moreover, the pick-up roller 303 is partially inserted into the third pick-up gear 3053. Consequently, the third pick-up gear 3053 is connected with the pick-up roller 303, and the pick-up roller 303 and the third pick-up gear 3053 are synchronously rotated.

In a case that the transmission shaft 393 is rotated in the second rotating direction C2 (see FIG. 7), the automatic document feeder 3 is operated in the standby mode. Under this circumstance, the first pick-up gear 3051 and the third pick-up gear 3053 are also rotated in the second rotating direction C2, and the second hooking element 302 and the second pick-up gear 3052 are rotated in the first rotating direction C1. Whereas, in a case that the transmission shaft 393 is rotated in the first rotating direction C1 (see FIG. 8), the automatic document feeder 3 is operated in the document-feeding mode. Under this circumstance, the first pick-up gear 3051 and the third pick-up gear 3053 are also rotated in the first rotating direction C1, and the second hooking element 302 and the second pick-up gear 3052 are rotated in the second rotating direction C2.

In this embodiment, the separation roller 304 is partially inserted into the first pick-up gear 3051, so that the separation roller 304 is connected with the first pick-up gear 3051. Moreover, the second hooking element 302 is partially inserted into the second pick-up gear 3052, so that the second hooking element 302 is connected with the second pick-up gear 3052. Moreover, the pick-up roller 303 is partially inserted into the third pick-up gear 3053, so that the third pick-up gear 3053 is connected with the pick-up roller 303. However, those skilled in the art will readily observe that numerous modifications and alterations may be made while retaining the teachings of the invention. For example, in some embodiments, the separation roller is connected with the first pick-up gear by partially inserting the first pick-up gear into the separation roller, the second hooking element is connected with the second pick-up gear by partially inserting the second pick-up gear into the second hooking element, and the third pick-up gear is connected with the pick-up roller by partially inserting the third pick-up gear into the pick-up roller.

Please refer to FIGS. 5 and 6 again. The document stopper 32 is disposed on the plural guide plates 312, and located beside the outer wall 3013 of the casing 301. The document stopper 32 may be swung relative to the plural guide plates 312. In a case that the automatic document feeder 3 is operated in the standby mode, the document stopper 32 is pushed and swung by the protrusion portion 3011 of the casing 301, so that the channel entrance 331 is block by the document stopper 32. Furthermore, as shown in FIG. 4, the channel entrance 331 has an indentation structure 3311. The indentation structure 3311 is located beside the conveying channel 33. In a case that the automatic document feeder 3 is operated in the standby mode, the document stopper 32 is swung to a position in contact with the indentation structure 3311, so that the channel entrance 331 is block by the document stopper 32. Whereas, in a case that the automatic document feeder 3 is operated in the document-feeding mode, the document stopper 32 is no longer in contact with the indentation structure 3311. In addition, the document stopper 32 is pushed by the at least one document S* to be swung toward the upper cover 31. Under this circumstance, the at least one document S* is allowed to go through the channel entrance 331.

Figure 7:
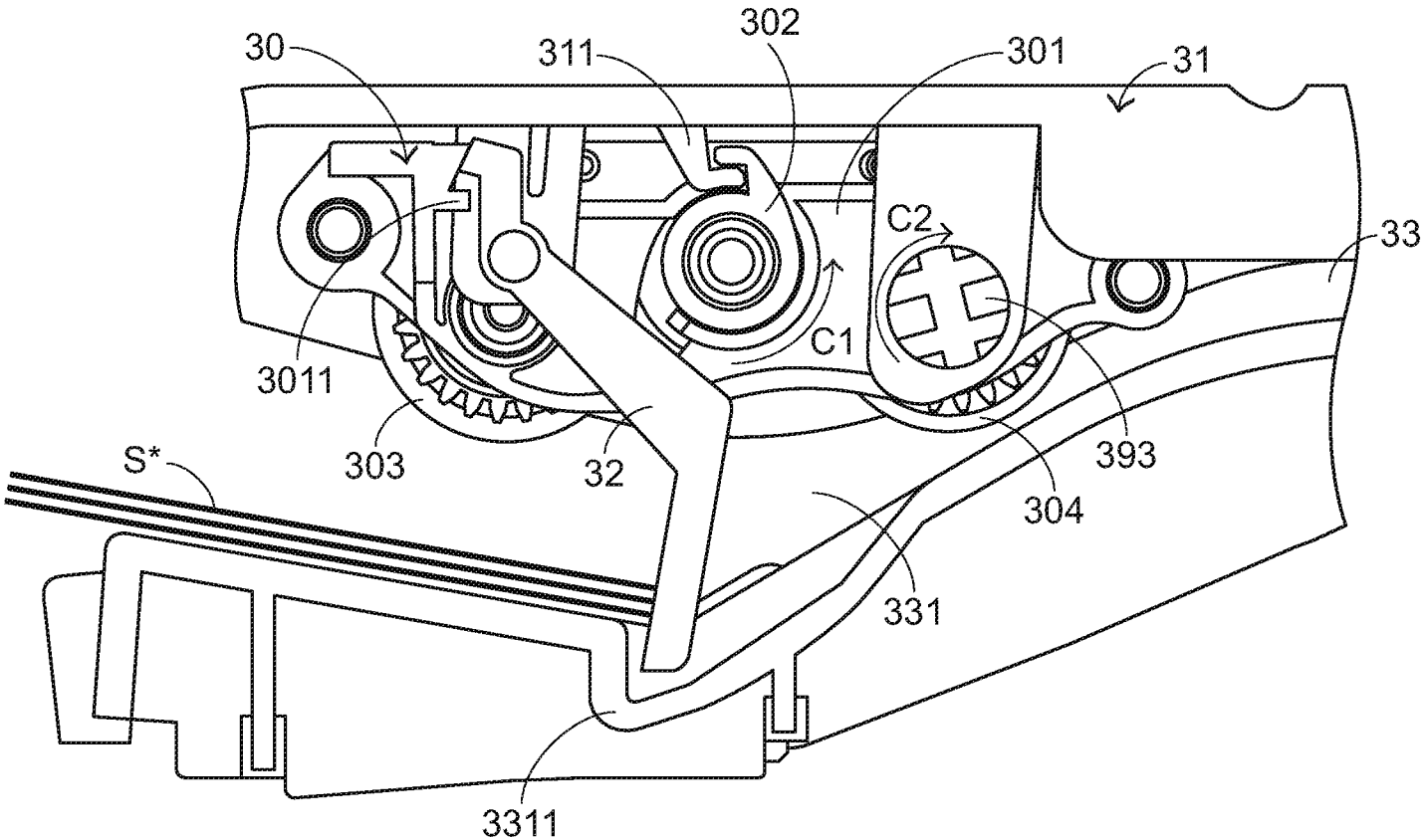
FIG. 7 is a schematic partial side view illustrating the automatic document feeder in a standby mode according to an embodiment of the present invention.

Hereinafter, the operations of the automatic document feeder 3 and the flatbed scanning portion 4 will be illustrated with reference to FIGS. 4 and 7. FIG. 7 is a schematic partial side view illustrating the automatic document feeder in a standby mode according to an embodiment of the present invention. In a case that the transmission shaft 393 of the transmission mechanism 39 is driven by the driving device 38 to be rotated in the second rotating direction C2 (e.g. a clockwise direction as shown in FIG. 7), the automatic document feeder 3 is operated in the standby mode. Consequently, the casing 301 of the document pick-up module 30 is swung to a position near the upper cover 31. At the same time, the first pick-up gear 3051 and the third pick-up gear 3053 are driven by the transmission mechanism 39 to be rotated in the second rotating direction C2, and the second hooking element 302 and the second pick-up gear 3052 are rotated in the first rotating direction C1 (e.g. an anti-clockwise direction as shown in FIG. 7).

During the casing 301 is swung toward the upper cover 31, the second hooking element 302 is rotated in the first rotating direction C1. Moreover, once the casing 301 is swung to the position near the upper cover 31, the second hooking element 302 is engaged with the first hooking element 311 of the upper cover 31, so that the casing 301 is fixed on the upper cover 31. Under this circumstance, the document pick-up module 30 is not contacted with the at least one document S*. On the other hand, as the casing 301 is swung, the document stopper 32 is pushed by the protrusion portion 3011 of the casing 301. Consequently, the document stopper 32 is rotated in the second rotating direction C2 and inserted into the indentation structure 3311 of the channel entrance 331 to block the channel entrance 331. Under this circumstance, the at least one document S* on the document input tray 34 is stopped from being fed into the conveying channel 33 through the channel entrance 331. That is, the document stopper 32 is perpendicular to the channel entrance 331 at this moment. Since the position of the document stopper 32 is limited by the protrusion portion 3011 of the casing 301 and the indentation structure 3311 of the channel entrance 331, the document stopper 32 fails to be continuously rotated in the second rotating direction C2. Meanwhile, the document stopper 32 is effective to block the channel entrance 331, and it is difficult to swing the document stopper 32.

Figure 8:
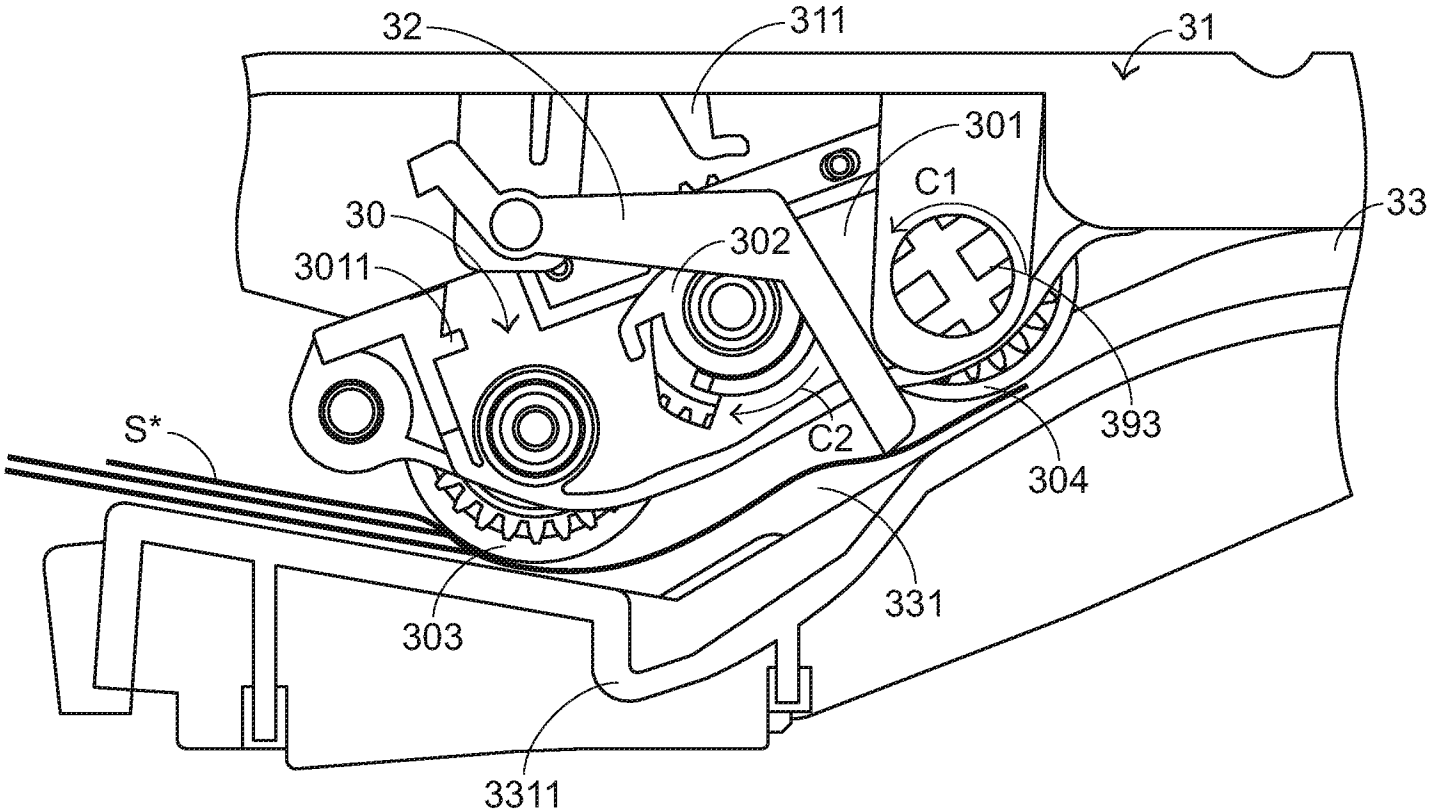
FIG. 8 is a schematic partial side view illustrating the automatic document feeder in a document-feeding mode according to an embodiment of the present invention.

FIG. 8 is a schematic partial side view illustrating the automatic document feeder in a document-feeding mode according to an embodiment of the present invention. Please refer to FIGS. 4 and 8. In a case that the transmission shaft 393 of the transmission mechanism 39 is driven by the driving device 38 to be rotated in the first rotating direction C1, the automatic document feeder 3 is operated in the document-feeding mode. At the same time, the first pick-up gear 3051 and the third pick-up gear 3053 are driven by the transmission mechanism 39 to be rotated in the first rotating direction C1, and the second hooking element 302 and the second pick-up gear 3052 are rotated in the second rotating direction C2. Correspondingly, the second hooking element 302 is detached and disengaged from the first hooking element 311 of the upper cover 31. Upon rotation of the transmission shaft 393, the casing 301 of the document pick-up module 30 is swung toward the position near the channel entrance 331.

When the document pick-up module 30 is swung to position near the channel entrance 331 and the document pick-up module 30 is contacted with the at least one document S*, the at least one document S* is transported into the channel entrance 331 by the pick-up roller 304, and the at least one document S* is separated by the separation roller 305. Consequently, the possibility of resulting in the multi-feeding problem will be minimized. Meanwhile, since the document pick-up module 30 is swung to the position near the channel entrance 331, the document stopper 32 is no longer pushed by the protrusion portion 3011 of the casing 301. In other words, the position of the document stopper 32 is limited by the protrusion portion 3011, and the document stopper 32 can be swung. When the at least one document S* is moved across the channel entrance 331, the feeding force provided by the document pick-up module 30 may allow the channel entrance 331 to push forward the document stopper 32. Consequently, the at least one document S* can be smoothly transported into the conveying channel 33 without being stopped by the document stopper 32.

Next, the at least one document S* is transported by the plural conveying roller assemblies 36, so that the at least one document S* is moved along the conveying channel 33. When the at least one document S* is moved across the region over the scanning module 40 of the flatbed scanning portion 4, the at least one document S* is scanned by the scanning module 40, so that a scanned image of the at least one document S* is acquired. Afterwards, the scanned document S* is transported by the document discharge roller assembly 37 to be ejected to the document discharge tray 35. Under this circumstance, the scanning operation of the uppermost document S* has been completed. The processes of scanning the remaining documents S* are similar to the above process, and are not redundantly described herein.

It is noted that the part of the transmission gear set 392 as shown in FIG. 4 is connected with the part of the transmission gear set 392 as shown in FIGS. 5 and 6. In addition, the part of the transmission gear set 392 as shown in FIGS. 5 and 6 and the transmission shaft 393 are fixed on the upper cover 31 (see FIG. 6). In a case that the automatic document feeder 3 is operated in the standby mode and the upper cover 31 is uplifted by the user, the document pick-up module 30, the document stopper 32, the part of the transmission gear set 392 as shown in FIGS. 5 and 6 and the transmission shaft 393 are distant from the channel entrance 331. Meanwhile, the relative positions between the document pick-up module 30 and the document stopper 32 are kept unchanged. That is, the document stopper 32 is still pushed by the protrusion portion 3011 of the document pick-up module 30, and the document stopper 32 is maintained perpendicular to the channel entrance 331 (i.e. the upright status as shown in FIG. 7). After the upper cover 31 is placed back, the document stopper 32 is inserted into the indentation structure 3311 of the channel entrance 331 while the document stopper 32 is maintained perpendicular to the channel entrance 331. Under this circumstance, the automatic document feeder 3 is maintained in the standby mode. That is, even if the upper cover 31 is uplifted, the automatic document feeder 3 can be maintained in the standby mode in order to assure that the at least one document S* is not fed into conveying channel 33.

From the above description, the present invention provides an automatic document feeder. In a case that the automatic document feeder is operated in the standby mode, the document pick-up module is swung to the position near the upper cover, and the second hooking element of the document pick-up module is inserted into the first hooking element of the upper cover. Consequently, the second hooking element is engaged with said first hooking element, and the document pick-up module is fixed on the upper cover without additional electricity. Even if the automatic document feeder is operated in a power-saving mode or a sleep mode, the document pick-up module is not stayed at the position near the upper cover, so that the document-stopping function of the document stopper is still achieved. Since the erroneous action of the document pick-up module is avoided, the possibility of resulting in the multi-feeding problem or the non-feeding problem will be minimized or eliminated. In comparison with the conventional automatic document feeder, the automatic document feeder of the present invention can avoid the erroneous action of the document pick-up module while enhancing the scanning quality.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding at least one document, said automatic document feeder comprising:

an upper cover having a first hooking element, wherein said first hooking element is disposed on an inner surface of said upper cover;

a conveying channel for allowing said at least one document to go through, wherein said conveying channel is disposed under said upper cover, and said conveying channel has a channel entrance; and a document pick-up module arranged between said upper cover and said channel entrance, wherein when said automatic document feeder is operated in a document-feeding mode, said at least one document is transported into said conveying channel by said document pick-up module, wherein said document pick-up module comprises:

a casing having a protrusion portion, which is disposed on an outer wall of said casing; and a second hooking element disposed on said casing and exposed to said outer wall, wherein said second hooking element is rotatable relative to said casing, and engaged with said first hooking element when said automatic document feeder is operated in a standby mode, wherein said casing further comprises a hollow portion, wherein said hollow portion runs through said outer wall of said casing and an inner wall of said casing for accommodating said second hooking element, wherein said protrusion portion is integrally formed with said casing, wherein when said automatic document feeder is operated in said standby mode, said casing is swung to a position near said upper cover and said second hooking element is engaged with said first hooking element, so that said casing is fixed on said upper cover, wherein when said automatic document feeder is operated in said document-feeding mode, said second hooking element is disengaged from said first hooking element and said casing is swung to a position near said channel entrance, so that said document pick-up module is contacted with said at least one document for transporting said at least one document into said conveying channel.

2. The automatic document feeder according to claim 1, wherein said document pick-up module further comprises:

a pick-up roller disposed within said casing and rotatable relative to said casing for transporting said at least one document into said conveying channel;

a separation roller disposed within said casing and rotatable relative to said casing for separating said at least one document, so that a single document transported by said pick-up roller is allowed to be fed into said conveying channel at each time; and a pick-up gear set connected with said pick-up roller and said separation roller, and located near an inner wall of said casing, wherein through said pick-up gear set, said pick-up roller and said second hooking element are rotated with said separation roller.

3. The automatic document feeder according to claim 2, wherein said pick-up gear set comprises:

a first pick-up gear arranged between said separation roller and said casing, and connected with said separation roller, so that said first pick-up gear and said separation roller are synchronously rotated;

a second pick-up gear engaged with said first pick-up gear and connected with said second hooking element, so that said second pick-up gear is rotated with said first pick-up gear, and said second hooking element and said second pick-up gear are synchronously rotated; and a third pick-up gear arranged between said pick-up roller and said casing, connected with said pick-up roller, and engaged with said second pick-up gear, so that said third pick-up gear is rotated with said second pick-up gear and said pick-up roller is rotated with said third pick-up gear, wherein when said automatic document feeder is operated in said standby mode, said first pick-up gear and said third pick-up gear are rotated in a second rotating direction, and said second hooking element and said second pick-up gear are rotated in a first rotating direction, wherein when said automatic document feeder is operated in said document-feeding mode, said first pick-up gear and said third pick-up gear are rotated in said first rotating direction, and said second hooking element and said second pick-up gear are rotated in said second rotating direction.

4. The automatic document feeder according to claim 1, further comprising a document stopper, wherein said document stopper is disposed on said upper cover, located near said outer wall of said casing, and rotatable relative to said upper cover, wherein when said automatic document feeder is operated in said standby mode, said document stopper is pushed by said protrusion portion, so that said document stopper is swung to block said channel entrance.

5. The automatic document feeder according to claim 4, wherein said channel entrance has an indentation structure, which is located beside said conveying channel, wherein when said automatic document feeder is operated in said standby mode, said document stopper is contacted with said indentation structure to block said channel entrance, wherein when said automatic document feeder is operated in said document-feeding mode, said document stopper is not contacted with said indentation structure and said document stopper is pushed by said at least one document to be swung toward said upper cover, so that said at least one document is allowed to go through said channel entrance.

6. An automatic document feeder for feeding at least one document, said automatic document feeder comprising:

an upper cover having a first hooking element, wherein said first hooking element is disposed on an inner surface of said upper cover;

a conveying channel for allowing said at least one document to go through, wherein said conveying channel is disposed under said upper cover, and said conveying channel has a channel entrance;

a document pick-up module arranged between said upper cover and said channel entrance, wherein when said automatic document feeder is operated in a document-feeding mode, said at least one document is transported into said conveying channel by said document pick-up module, wherein said document pick-up module comprises:

a casing having a protrusion portion, which is disposed on an outer wall of said casing; and a second hooking element disposed on said casing and exposed to said outer wall, wherein said second hooking element is rotatable relative to said casing, and engaged with said first hooking element when said automatic document feeder is operated in a standby mode, wherein when said automatic document feeder is operated in said standby mode, said casing is swung to a position near said upper cover and said second hooking element is engaged with said first hooking element, so that said casing is fixed on said upper cover, wherein when said automatic document feeder is operated in said document-feeding mode, said second hooking element is disengaged from said first hooking element and said casing is swung to a position near said channel entrance, so that said document pick-up module is contacted with said at least one document for transporting said at least one document into said conveying channel; and a document stopper, wherein said document stopper is disposed on said upper cover, located near said outer wall of said casing, and rotatable relative to said upper cover, wherein when said automatic document feeder is operated in said standby mode, said document stopper is pushed by said protrusion portion, so that said document stopper is swung to block said channel entrance, wherein said upper cover further comprises plural guide plates, wherein said plural guide plates are disposed on said inner surface of said upper cover and perpendicular to said inner surface for guiding said at least one document to be moved within said conveying channel, wherein said document stopper is disposed on said plural guide plates, and said document stopper is permitted to be swung relative to said plural guide plates.

7. An automatic document feeder for feeding at least one document, said automatic document feeder comprising:

an upper cover having a first hooking element, wherein said first hooking element is disposed on an inner surface of said upper cover;

a conveying channel for allowing said at least one document to go through, wherein said conveying channel is disposed under said upper cover, and said conveying channel has a channel entrance;

a document pick-up module arranged between said upper cover and said channel entrance, wherein when said automatic document feeder is operated in a document-feeding mode, said at least one document is transported into said conveying channel by said document pick-up module, wherein said document pick-up module comprises:

a casing having a protrusion portion, which is disposed on an outer wall of said casing; and a second hooking element disposed on said casing and exposed to said outer wall, wherein said second hooking element is rotatable relative to said casing, and engaged with said first hooking element when said automatic document feeder is operated in a standby mode, wherein when said automatic document feeder is operated in said standby mode, said casing is swung to a position near said upper cover and said second hooking element is engaged with said first hooking element, so that said casing is fixed on said upper cover, wherein when said automatic document feeder is operated in said document-feeding mode, said second hooking element is disengaged from said first hooking element and said casing is swung to a position near said channel entrance, so that said document pick-up module is contacted with said at least one document for transporting said at least one document into said conveying channel;

a driving device disposed under said upper cover for providing a motive power; and a transmission mechanism connected with said driving device and said document pick-up module for transferring said motive power to said document pick-up module, so that said automatic document feeder is selectively operated in said document-feeding mode or said standby mode, wherein said transmission mechanism comprises:

a transmission belt connected with said driving device for transferring said motive power;

a transmission gear set connected with said transmission belt, and rotatable in response to said motive power; and a transmission shaft penetrated through said transmission gear set and said document pick-up module, wherein in response to said motive power, said transmission shaft is rotated in a first rotating direction or a second rotating direction, and said casing is swung to said position near said upper cover or said casing is swung to said position near said channel entrance.

8. The automatic document feeder according to claim 7, wherein said transmission shaft is penetrated through a separation roller of said document pick-up module and said casing, so that said separation roller is rotated in response to said motive power, wherein said driving device is a driving motor, wherein said automatic document feeder is operated in said document-feeding mode when said transmission shaft is rotated in said first rotating direction, and said automatic document feeder is operated in said standby mode when said transmission shaft is rotated in said second rotating direction.

9. The automatic document feeder according to claim 8, wherein said second hooking element is connected with said separation roller through a pick-up gear set of said document pick-up module, so that said second hooking element is rotated with said transmission shaft, wherein when said transmission shaft is rotated in said second rotating direction, said automatic document feeder is operated in said standby mode, and said second hooking element is rotated in said first rotating direction, wherein as said second hooking element is rotated in said first rotating direction, said casing is swung to said position near said upper cover and said second hooking element is engaged with said first hooking element, so that said document pick-up module is fixed on said upper cover without being contacted with said at least one document, wherein when said transmission shaft is rotated in said first rotating direction, said automatic document feeder is operated in said document-feeding mode and said second hooking element is rotated in said second rotating direction, wherein as said second hooking element is rotated in said second rotating direction, said second hooking element is disengaged from said first hooking element and said casing is swung to said position near said channel entrance, so that said document pick-up module is contacted with said at least one document for transporting said at least one document into said conveying channel.

* * * * *